US007086119B2

(12) United States Patent
Go et al.

(10) Patent No.: US 7,086,119 B2
(45) Date of Patent: Aug. 8, 2006

(54) DUST COLLECTING UNIT OF VACUUM CLEANER

(75) Inventors: Il-Gyeong Go, Jinhae-si (KR); Young-Gun Min, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/788,396

(22) Filed: Mar. 1, 2004

(65) Prior Publication Data

US 2004/0177472 A1 Sep. 16, 2004

(30) Foreign Application Priority Data

May 10, 2003 (KR) ..... 10-2003-0029630

(51) Int. Cl.
*A47L 9/16* (2006.01)

(52) U.S. Cl. ..... 15/353; 15/347; 15/327.7; 55/359; 55/426; 55/429; 55/DIG. 3

(58) Field of Classification Search ..... 15/347, 15/350–353, 327.1, 327.2, 327.6, 327.7; 55/337, 359, 426, 429, DIG. 3
See application file for complete search history.

(56) References Cited

U.S. PATENT DOCUMENTS 2,432,757 A * 12/1947 Weniger ..... 96/376
4,172,710 A * 10/1979 van der Molen ..... 55/340
6,168,641 B1 1/2001 Tuvin et al.
6,228,260 B1 * 5/2001 Conrad et al. ..... 210/304
6,334,234 B1 * 1/2002 Conrad et al. ..... 15/347
6,398,834 B1 6/2002 Oh
6,406,505 B1 * 6/2002 Oh et al. ..... 55/337
6,436,160 B1 * 8/2002 Stephens et al. ..... 55/337
6,502,278 B1 1/2003 Oh et al.
6,532,620 B1 3/2003 Oh
6,553,612 B1 4/2003 Dyson et al.
6,596,044 B1 7/2003 Bilek et al.
6,613,129 B1 9/2003 Gen
6,640,385 B1 * 11/2003 Oh et al. ..... 15/352
6,706,095 B1 3/2004 Morgan
6,874,197 B1 * 4/2005 Conrad et al. ..... 15/353
2001/0018865 A1 * 9/2001 Wegelin et al. ..... 95/268
2001/0054213 A1 * 12/2001 Oh et al. ..... 15/353
2002/0011052 A1 * 1/2002 Oh et al. ..... 55/424
2002/0011053 A1 * 1/2002 Oh ..... 55/426
2002/0029436 A1 * 3/2002 Hawkins et al. ..... 15/339
2002/0046438 A1 * 4/2002 Oh ..... 15/353
2002/0166199 A1 * 11/2002 Boles et al. ..... 15/352
2003/0159412 A1 8/2003 North
2004/0068827 A1 4/2004 Dyson

* cited by examiner

*Primary Examiner*—Terrence R. Till
(74) *Attorney, Agent, or Firm*—Fleshner & Kim, LLP

(57) ABSTRACT

A dust collecting unit for a vacuum cleaner is provided. The dust collecting unit includes a dust separating chamber with an air inlet formed on an outer surface thereof and an air outlet formed on one side thereof, a main dust collecting chamber formed in the dust separating chamber for separating dust and dirt in a cyclonic fashion, an auxiliary dust collecting chamber formed at one side of the main dust collecting chamber, and a partition plate for partitioning the main dust collecting chamber. The dust collecting unit allows an amount of air sucked and the efficiency of collecting dust and dirt to be greatly increased.

13 Claims, 8 Drawing Sheets

DUST COLLECTING UNIT OF VACUUM CLEANER

BACKGROUND OF THE INVENTION

1. Field of Invention

The present invention relates to a dust collecting unit for a vacuum cleaner, and more particularly, to an improved dust collecting unit for a cyclonic vacuum cleaner capable of more efficiently performing a dust collecting function and easily treating the collected dust and dirt.

2. Description of the Prior Art

A vacuum cleaner is an apparatus which sucks air containing foreign materials using a vacuum pressure generated by a vacuum motor installed in a main body of the vacuum cleaner, filters out the dust and dirt from the air within the main body and then casts the collected dust and dirt.

Further, a paper filter taking the shape of an envelope has been generally used as a filter for filtering out the suctioned foreign materials. Such paper filter is designed to allow air to penetrate therethrough but the foreign materials such as the dust and dirt to remain therein so that the dust and dirt contained in the suctioned air can be filtered out.

However, the vacuum cleaner with such paper filter has inconvenience of use in that if the foreign materials are accumulated within the paper filter to a predetermined level after a certain period of use, a suction force of the vacuum cleaner is reduced and thus the paper filter muted be periodically replaced.

To solve the above inconvenience, a vacuum cleaner for performing the filtering in a cyclonic fashion has been proposed.

FIG. 1 shows a conventional cyclonic vacuum cleaner. Referring to FIG. 1, the vacuum cleaner comprises a main body 10 in which a suction means for sucking air in a room is installed, a flexible connection tube 24 which is connected to the main body 10 to communicate with the interior of the main body, a variable length extension tube 22 which is connected to an end of the connection tube 24 to communicate with the interior of the connection tube, and a suction nozzle 21 for sucking air containing foreign materials from a floor by means of a suction force generated in the main body 10.

Further, in the main body 10 is installed a dust collecting unit 11 which is detachably mounted to a rear side of the main body. The dust collecting unit 11 causes the air sucked from the suction nozzle 21 to be introduced therein and then the dust and dirt in the air to be collected in a cyclonic fashion. Further, at one side of the main body 10 is formed a discharge portion 19 for discharging the air, from which the foreign materials are filtered out through the dust collecting unit 11, to the atmosphere.

A pair of wheels 18 for traveling the main body 10 on the floor are rotatably installed on a lower surface of the main body 10. Further, a power cord 16 for supplying the vacuum cleaner with electric power is installed at another side of the main body 10. The power cord 16 can be wound around a cord reel (not shown) in the main body and be stored in the main body.

The dust collecting unit 11 includes a grip 12 for allowing a user to hold the unit when it is rearward mounted to or demounted from the main body 10. Further, a handle 14, which the user can grip when intending to carry the vacuum cleaner, is installed at a top surface of the main body 10.

When the main body 10 of the vacuum cleaner so constructed is operated, the suction force is transmitted to the suction nozzle 21 through the connection tube 24 and the extension tube 22 by means of the vacuum pressure generated in the main body. Here, the suction force of the vacuum cleaner can be adjusted by a switch 25 that is installed on a grip portion 23 coupled to an upper portion of the extension tube 22.

In addition, the air containing the foreign materials on the floor to be cleaned is introduced into the main body 10 through the suction nozzle 21, the extension tube 22 and the connection tube 24 by means of the suction force. Then, the air is introduced into the dust collecting unit 11, and the dust and dirt are filtered out by a predetermined filter and additionally discharged to the outside.

A high power motor should have been used in such a dust collecting unit 11 to compensate for a loss of suction force caused in an air flow path of the vacuum cleaner. Further, there is a problem in that a plurality of steps of discharging the collected dust and dirt from the dust collecting unit 11 to the outside must be performed.

SUMMARY OF THE INVENTION

The present invention is conceived to solve the aforementioned problems in the prior art. Accordingly, an object of the present invention is to provide a dust collecting unit for a cyclonic vacuum cleaner capable of sucking, separating and collecting dust and dirt without a loss of suction force.

Another object of the present invention is to provide a dust collecting unit of a cyclonic vacuum cleaner wherein a noise and loss of power can be reduced by allowing a low power motor to be used due to no loss of suction force.

A further object of the present invention is to provide a dust collecting unit of a cyclonic vacuum cleaner capable of easily performing a process of detaching the dust collecting unit from the vacuum cleaner.

According to an aspect of the present invention for achieving the objects, there is provided a dust collecting unit for a vacuum cleaner, comprising a dust separating chamber with an air inlet formed on an outer surface thereof and an air outlet formed on one side thereof, a main dust collecting chamber formed in the dust separating chamber for separating dust and dirt in a cyclonic fashion, an auxiliary dust collecting chamber formed at one side of the main dust collecting chamber, a partition plate for partitioning the main dust collecting chamber, wherein the main dust collecting chamber is divided into an upper cyclonic part where air flows cyclonically and an lower collecting part without cyclonic air flow, and a bottom cover openably mounted to the bottom of the dust separating chamber.

According to another aspect of the present invention, there is provided a dust collecting unit for a vacuum cleaner, comprising a dust separating chamber with an air inlet formed on an outer surface thereof and an air outlet formed on one side thereof, a main dust collecting chamber formed in the dust separating chamber for separating dust and dirt in a cyclonic fashion, an auxiliary dust collecting chamber formed at one side of the main dust collecting chamber, and a partition plate which partitions the main dust collecting chamber into a cyclonic part and a collecting part and includes at least one opening.

According to a further aspect of the present invention, there is provided a dust collecting unit for a vacuum cleaner, comprising a dust separating chamber with an air inlet tangentially formed on an outer surface thereof and an air outlet formed on one side thereof, a main dust collecting chamber formed in the dust separating chamber for separating dust and dirt in a cyclonic fashion, an auxiliary dust collecting chamber formed at one side of the main dust collecting chamber, a partition plate for partitioning the main dust collecting chamber into a cyclonic part and a collecting part, and a communicating hole formed at an upper side of the main dust collecting chamber for causing air to be introduced from the main dust collecting chamber to the auxiliary dust collecting chamber.

According to a still further aspect of the present invention, there is provided a dust collecting unit for a vacuum cleaner, comprising a dust separating chamber with an air inlet formed on an outer surface thereof and an air outlet formed on one side thereof, a main dust collecting chamber formed in the dust separating chamber for separating dust and dirt in a cyclonic fashion, an auxiliary dust collecting chamber formed at one side of the main dust collecting chamber, a partition plate for partitioning the main dust collecting chamber into a cyclonic part and a collecting part, and a communicating hole formed at an upper side and a lower side of the main dust collecting chamber for causing air to be introduced from the main dust collecting chamber to the auxiliary dust collecting chamber.

According to the present invention so constructed, since a sufficient suction force can be obtained by even a low power vacuum cleaner, a lower-price motor can be used to reduce a manufacturing cost of the vacuum cleaner. Further, there is an advantage in that convenience of use can be improved since the collected dust and dust can be easily discharged to the outside.

BRIEF DESCRIPTION OF THE DRAWINGS

The above and other objects, features and advantages of the present invention will become apparent from the following description of a preferred embodiment given in conjunction with the accompanying drawings, in which.

DETAILED DESCRIPTION OF THE PREFERRED EMBODIMENT

Figure 1:
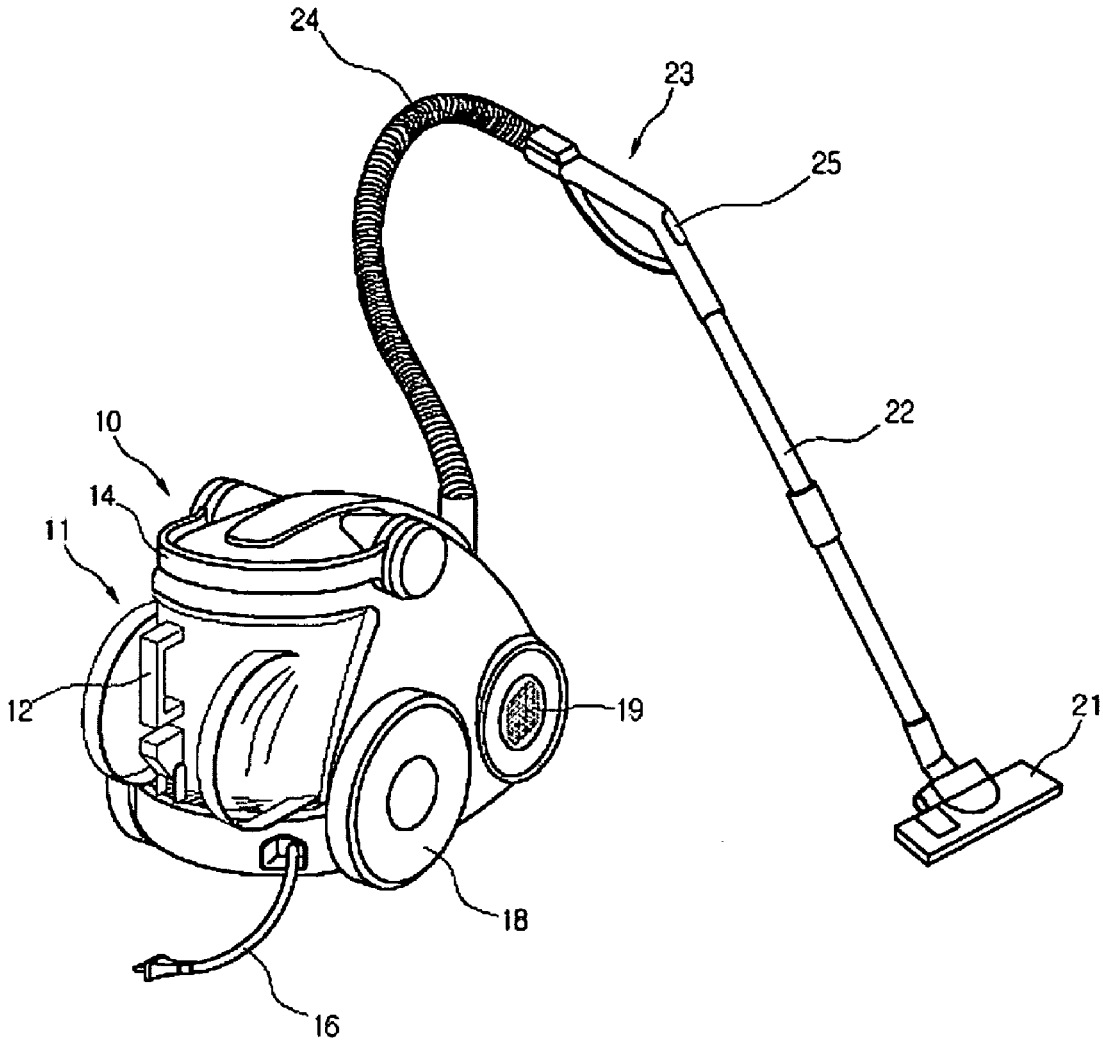
FIG. 1 Related Art
FIG. 1 is a perspective view of a vacuum cleaner for performing a general cyclonic filtering function.

Hereinafter, a preferred embodiment of a dust collecting unit for a vacuum cleaner according to the present invention will be described in detail with reference to the accompanying drawings. Throughout the drawings, like reference numerals are used to designate like elements.

Figure 2:
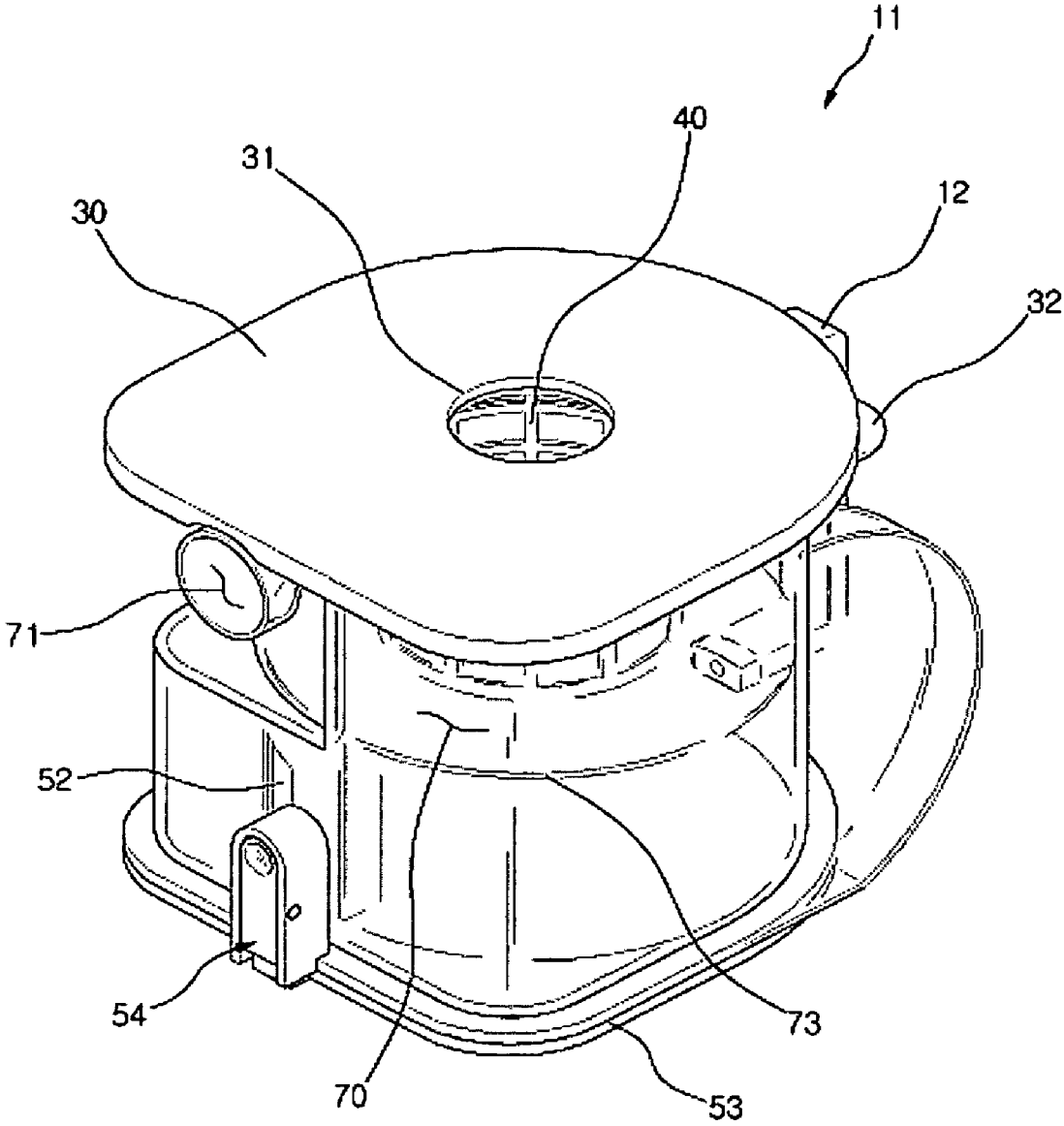
FIG. 2 is a front perspective view of a dust collecting unit of a cyclonic vacuum cleaner according to the present invention.
Figure 3:
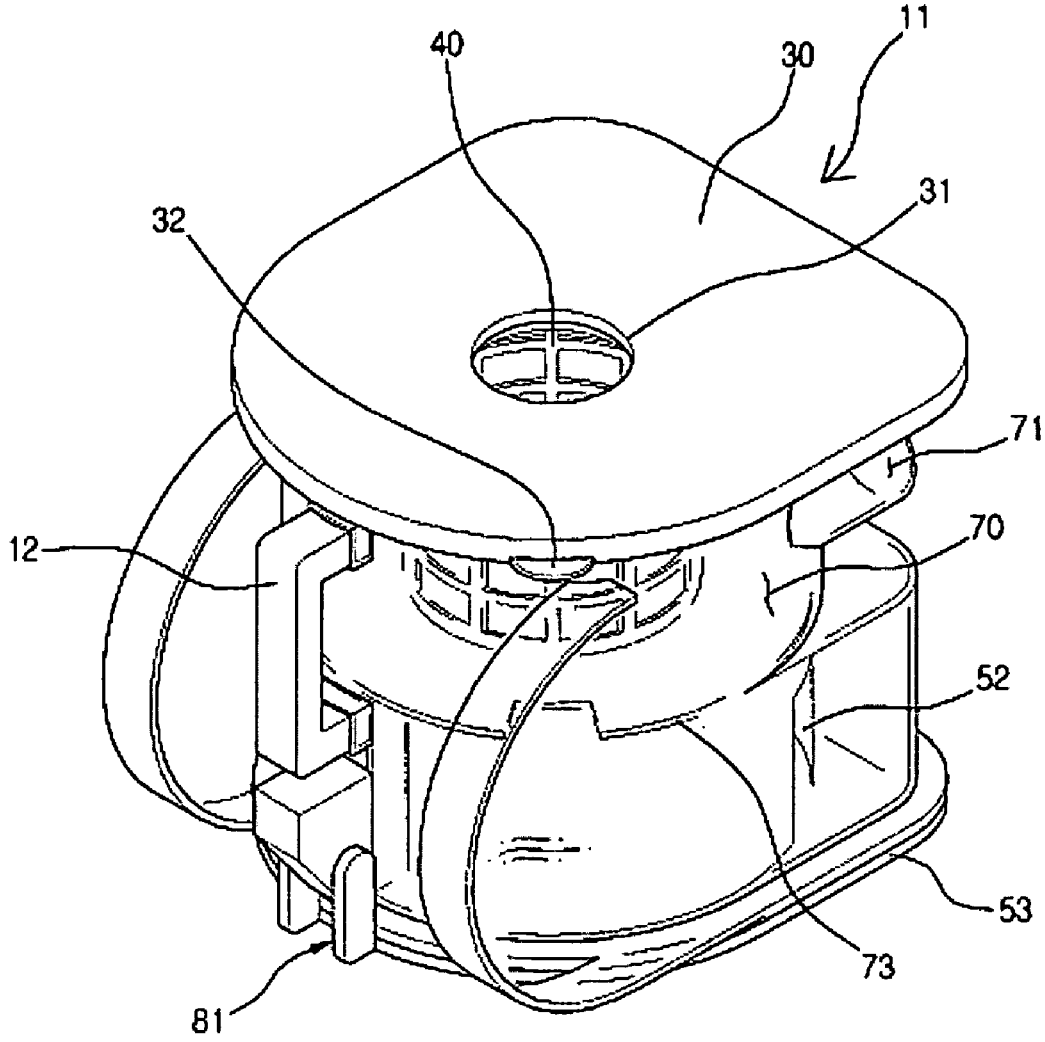
FIG. 3 is a rear perspective view of the dust collecting unit of the cyclonic vacuum cleaner according to the present invention.
Figure 4:
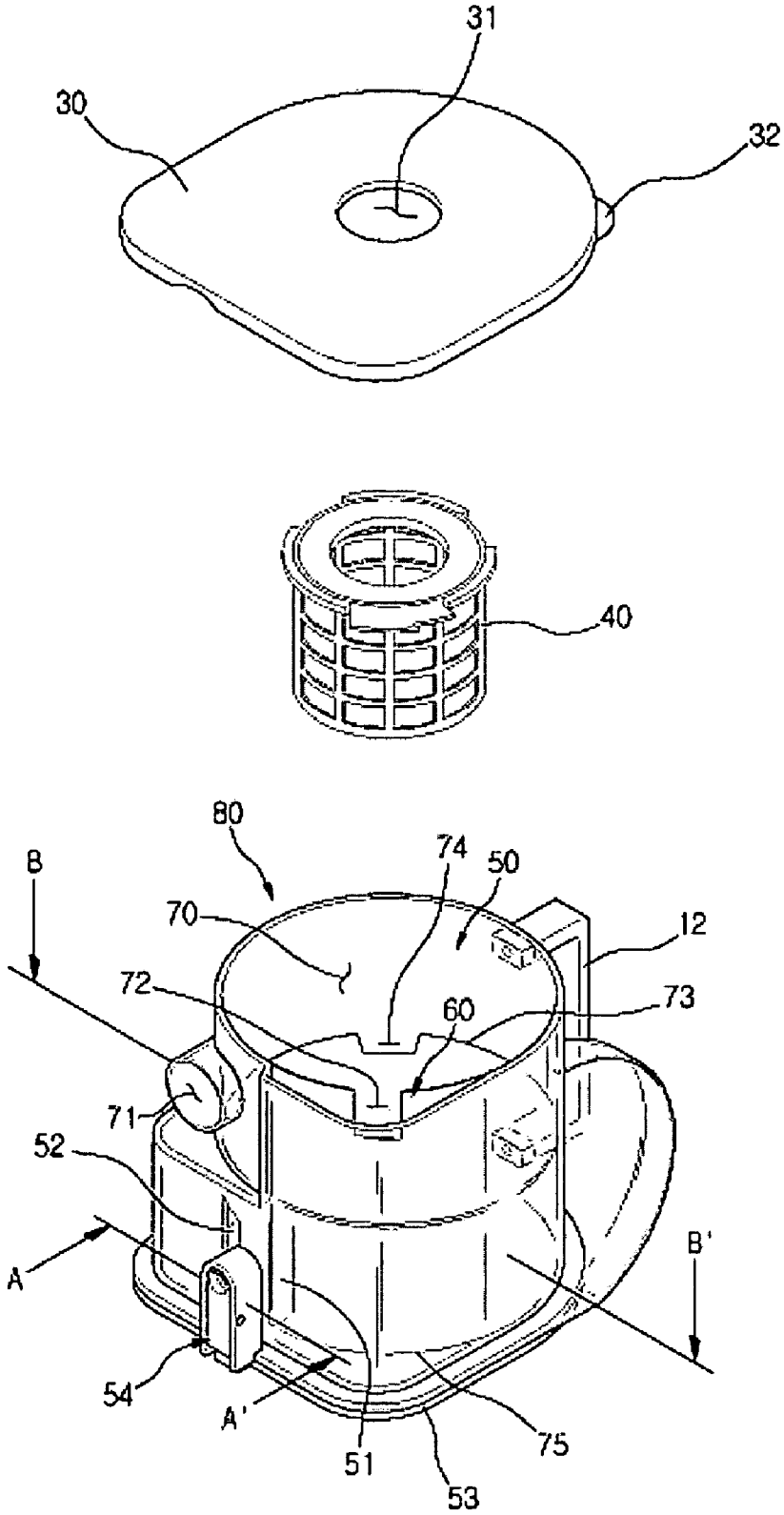
FIG. 4 is an exploded perspective view of the dust collecting unit of the cyclonic vacuum cleaner according to the present invention.
Figure 5:
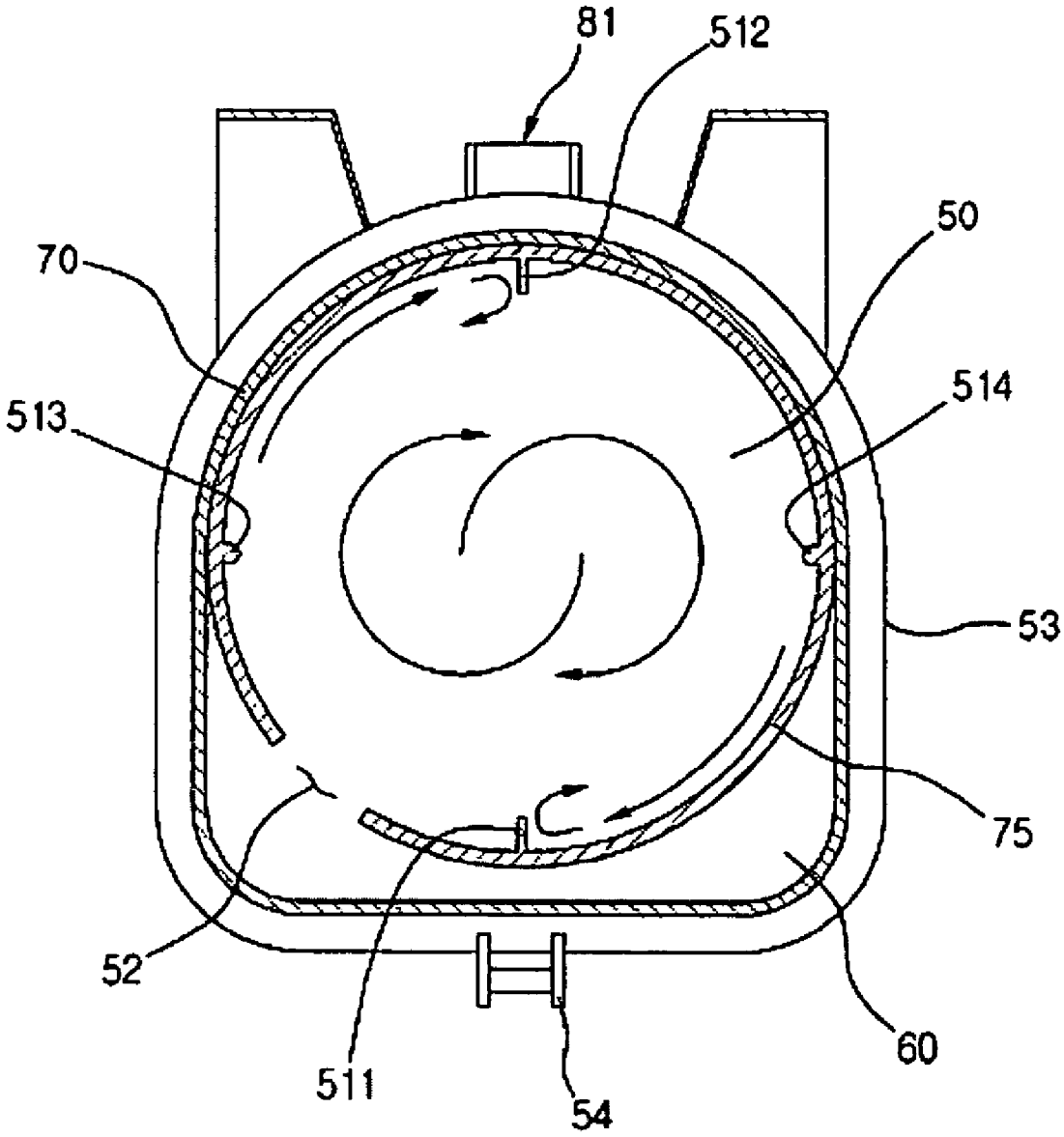
FIG. 5 is a sectional view taken along line B–B' of FIG. 4.

FIG. 2 is a front perspective view of a dust collecting unit for a cyclonic vacuum cleaner according to the present invention, FIG. 3 is a rear perspective view of the dust collecting unit for the cyclonic vacuum cleaner according to the present invention, FIG. 4 is an exploded perspective view of the dust collecting unit for the cyclonic vacuum cleaner according to the present invention, and FIG. 5 is a sectional view taken along line B–B' of FIG. 4.

Referring to these figures, the vacuum cleaner of the present invention comprises a cover 30 for covering an upper end of the dust collecting unit 11 to protect inner parts and hermetically sealing the unit to prevent sucked air from leaking out, a filter 40 installed downward from the cover around an outlet 31 formed near the center of the cover, and a dust collecting casing 80 attached to a bottom side of the cover 30.

More specifically, near the center of the cover 30 is formed the outlet 31 through which clean air with dust and dirt filtered out from the air sucked in the dust collecting casing 80 is discharged. The filter 40 in which a fine filtering structure is implemented is positioned below the outlet 31 to filter out fine particles.

The filter 40 is cylindrical and is formed with the fine filtering structure on an outer periphery thereof. The air in the dust collecting casing 80 is filtrated by the filter 40 and then discharged to the outside through the outlet 31.

Further, the dust collecting casing 80 comprises an inlet 71 through which air is introduced from the main body of the vacuum cleaner into the dust collecting unit 11, a cylindrical dust separation chamber 70 in which the air sucked through the inlet 71 swirls by a centrifugal force and the dust and dirt fallen by their own weight are separated from the air, and a main dust collecting chamber 50 which is formed below the dust separation chamber 70 so that the dust and dirt fallen by their own weight are accumulated.

Further, the dust collecting casing 80 includes a partition plate 73 which is installed in the dust separating chamber 70 to horizontally partition the main dust collecting chamber 50. At an outer periphery of the partition plate 73 is formed an opening through which the dirt and dust swirling in the dust separating chamber 70 are dropped into the main dust collecting chamber 50.

The main dust collecting chamber 50 is divided by the partition plate 73 into an upper part (an cyclonic part) where air flows cyclonically and a lower part (a collecting part) without cyclonic air flow.

The partition plate 73 may be integrally formed in the dirt separating chamber 70. Alternatively, the partition plate 73 may be installed in the dirt separating chamber using additional fixing means so that it can be opened and closed.

Due to their light weight, the dust and dirt may not be dropped into the main chamber 50 through the opening 74. To separate such light dirt and dust, the dust collecting casing 80 further includes an upper communicating hole 72 formed at an upper circumferential surface of the dust separating chamber 70 and an auxiliary dust collecting chamber 60 formed at one side of the main dust collecting chamber 50.

Further, in the dust collecting casing are formed a boundary wall 75 which partitions the auxiliary dust collecting chamber 60 and the main dust collecting chamber 50 and a lower communicating hole 52 which penetrates the boundary wall 75 and communicates the main dust collecting chamber 50 and the auxiliary dust collecting chamber 60 with each other to enhance dust collection efficiency.

A bottom cover 53 for causing bottom faces of the main and auxiliary dust collecting chambers 50 and 60 to be opened and closed, a hinge portion 81 for pivoting the whole lower plate 53 thereon, and a lower plate fixing means 54 for maintaining the lower plate 53 into its fixed location are further formed.

A grip 12 which extends vertically to allow a user to grip is also formed on an outer surface of the dust collecting casing 80. A stop plate 51 which protrudes inwardly from an inner surface and extends to a certain level in a vertical direction is formed to prevent the dust and dirt from swirling in the main dust collecting chamber 50, thereby increasing a suction force.

Further, the inlet 71 is formed tangentially to the dust separating chamber 70 to allow the sucked air to swirl such that the dust and dirt can be separated from the air due to a centrifugal force of the air.

Furthermore, a cover protrusion 32 for allowing the user to easily detach the cover from the dust collecting unit 11 is formed at an outer periphery of the cover 30.

More specifically, the auxiliary dust collecting chamber 60 for collecting fine dust in the main dust collecting chamber 50 is formed at a front side of the main dust collecting chamber 50, i.e. at a side opposite to the grip 12. The auxiliary dust collecting chamber 60 is formed as another space divided from the main dust collecting chamber 50 by the boundary wall 75 that is positioned between the two chambers and corresponds to a side wall of the main dust collecting chamber 50. The fine dust swirling continuously in an upper space of the main dust collecting chamber 50 is collected in the auxiliary dust collecting chamber 60 via the upper communicating hole 72. A probable influence caused by different air flow, which can be exerted mutually on the main dust collecting chamber 50 and the auxiliary dust collecting chamber 60, can be reduced by the boundary wall 75.

Only the upper and lower communicating holes 72 and 52 are formed on the boundary wall 75 of the main dust collecting chamber 50 to cause the main and auxiliary dust collecting chambers 50 and 60 to communicate with each other.

The upper communicating hole 72 allows the fine dust in the sucked air, which cannot be freely dropped into the main dust collecting chamber due to its light weight and continuously swirls in an upper space of the dust separating chamber 70, to move into the auxiliary dust collecting chamber 60. Since the upper communicating hole 72 allows the fine dust drifting and swirling along an upper wall of the dust separating chamber 70 to be introduce into the auxiliary dust collecting chamber 60, it is preferred that the upper communicating hole 72 be formed at an upper portion of the boundary wall 75.

In addition, the lower communicating hole 52 is formed at a lower portion of the boundary wall 75 to allow a part of the dust and dirt accumulated in the main dust collecting chamber 50 to be accommodated in the auxiliary dust collecting chamber 60.

More specifically, large dust is primarily collected in the main dust collecting chamber 50 of the dust collecting casing 80 whereas fine dust is collected in the auxiliary dust collecting chamber 60. Thus, even though the main dust collecting chamber 50 is fully filled with the dust, there may occur a case where the auxiliary dust collecting chamber 60 still has a space enough to accommodate the dust. The lower communicating hole 52 is formed to move a part of the dust in the main dust collecting chamber 50 to the auxiliary dust collecting chamber 60 in such a case where the dust is overflowed from the main dust collecting chamber 50.

As described above, in a case where the main dust collecting chamber 50 is fully filled with the dust, the dust in the main dust collecting chamber 50 can be moved naturally to the auxiliary dust collecting chamber 60 through the lower communicating hole 52 so that the entire dust collecting space of the dust collecting casing 80 can be more efficiently used.

Further, since the lower communicating hole 52 is formed, a part of the air introduced from the inlet 71 can flow through the upper and lower communicating holes 72 and 52 into the main dust collecting chamber 50. Thus, a flow path from the inlet to the chamber is not interrupted but continued so that a loss of the suction force can be prevented. If the lower communicating hole 52 is not formed, a vortex is formed in the auxiliary dust collecting chamber 60 due to the air passed through the upper communicating hole 72. As a result, since the air corresponding to the formed vortex cannot flow, a loss of the suction force occurs.

The cylindrical filter 40 is installed below the outlet 31 and detachably mounted on a bottom surface the cover 30 such that the cylindrical interior thereof communicates with the outlet 31. The air from which the dust and dirt are filtered out is further purified while passing through the filter 40, and the purified air is then discharged to the outside of the main body.

Referring to FIG. 5, one or more stop plates 511, 512, 513 and 514 protrude inwardly from the inner surface of the dust separating chamber 70 which constitutes the boundary wall of the main dust collecting chamber 50. It can also be seen from this figure that the boundary wall 75 for dividing the auxiliary dust collecting chamber 60 from the main dust collecting chamber 50 and the lower communicating hole 52 penetrating the boundary wall 75 are further formed.

The stop plates 511, 512, 513 and 514 prevent the air in the main dust collecting chamber 50 from swirling to allow the dust and dirt to be accumulated near the plates. In other words, the dust and dirt do not continuously swirl but are accumulated in the main dust collecting chamber 50 so that the collected dust and dirt are not again discharged from the main dust collecting chamber.

FIG. 5 illustrates an air flow direction designated by arrows. That is, FIG. 5 schematically shows that the dust and dirt are trapped and stopped by the stop plates 511, 512, 513 and 514 and then accumulated near the stop plates.

Figure 6:
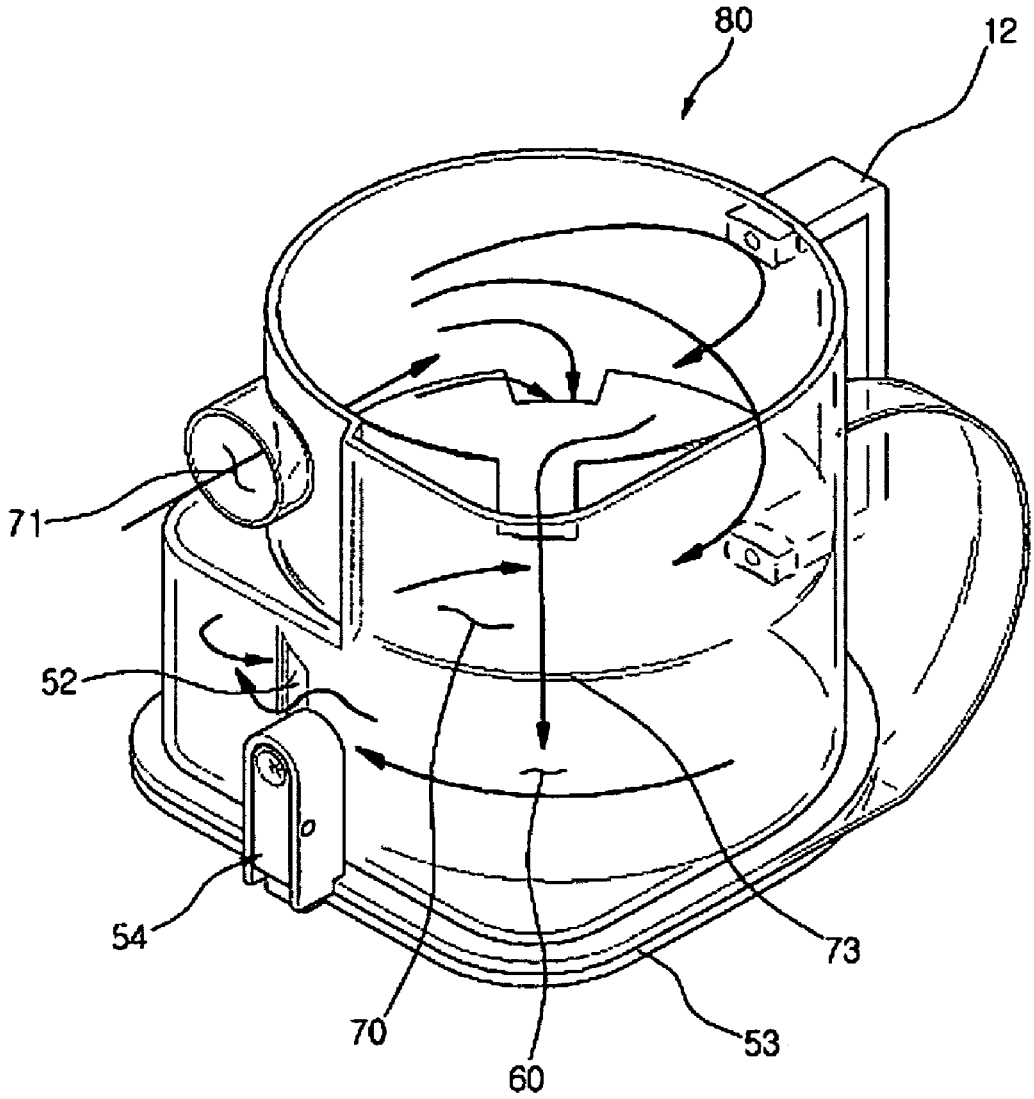
FIG. 6 is a view illustrating an operating state of the cyclonic vacuum cleaner according to the present invention.

FIG. 6 is a view illustrating an operating state of the cyclonic vacuum cleaner according to the present invention.

An operation for collecting the dust and dirt in the dust collecting casing 80 will be described with reference to FIG. 6. Once the vacuum cleaner is operated, the air containing the dust and dirt is sucked into the dust collecting casing 80 through the aforementioned suction nozzle, extension tube and suction tube and then through the inlet 71 of the dust collecting casing 80. Then, the sucked air swirls along the inner wall surface of the cylindrical dust separating chamber 70. At this time, the heavy dust and dirt are moved into the main dust collecting chamber 50 through the opening 74 formed on the outer periphery of the partition plate 73.

The fine dust, which cannot be dropped due to its light weight while swirling along the inner surface of the dust separating chamber 70, is collected into the auxiliary dust collecting chamber 60 through the upper communicating hole 72 of the boundary wall 75. At this time, the air is again moved into the main dust collecting chamber 50 through the upper and lower communicating holes 72 and 52, and it is then discharged to the outside via the filter 40.

In addition, a part of the dust and dirt accumulated in the main dust collecting chamber 50 is moved to the auxiliary dust collecting chamber 60 via the lower communicating hole 52. Thus, even though the dust and dirt are accumulated beyond a certain level in the main dust collecting chamber 50, the air suction efficiency of the vacuum cleaner is not influenced by the accumulated dust and dirt.

As described above, arrows shown in FIG. 6 specifically indicate the circulation paths of the air sucked in the dust collecting unit.

Figure 7:
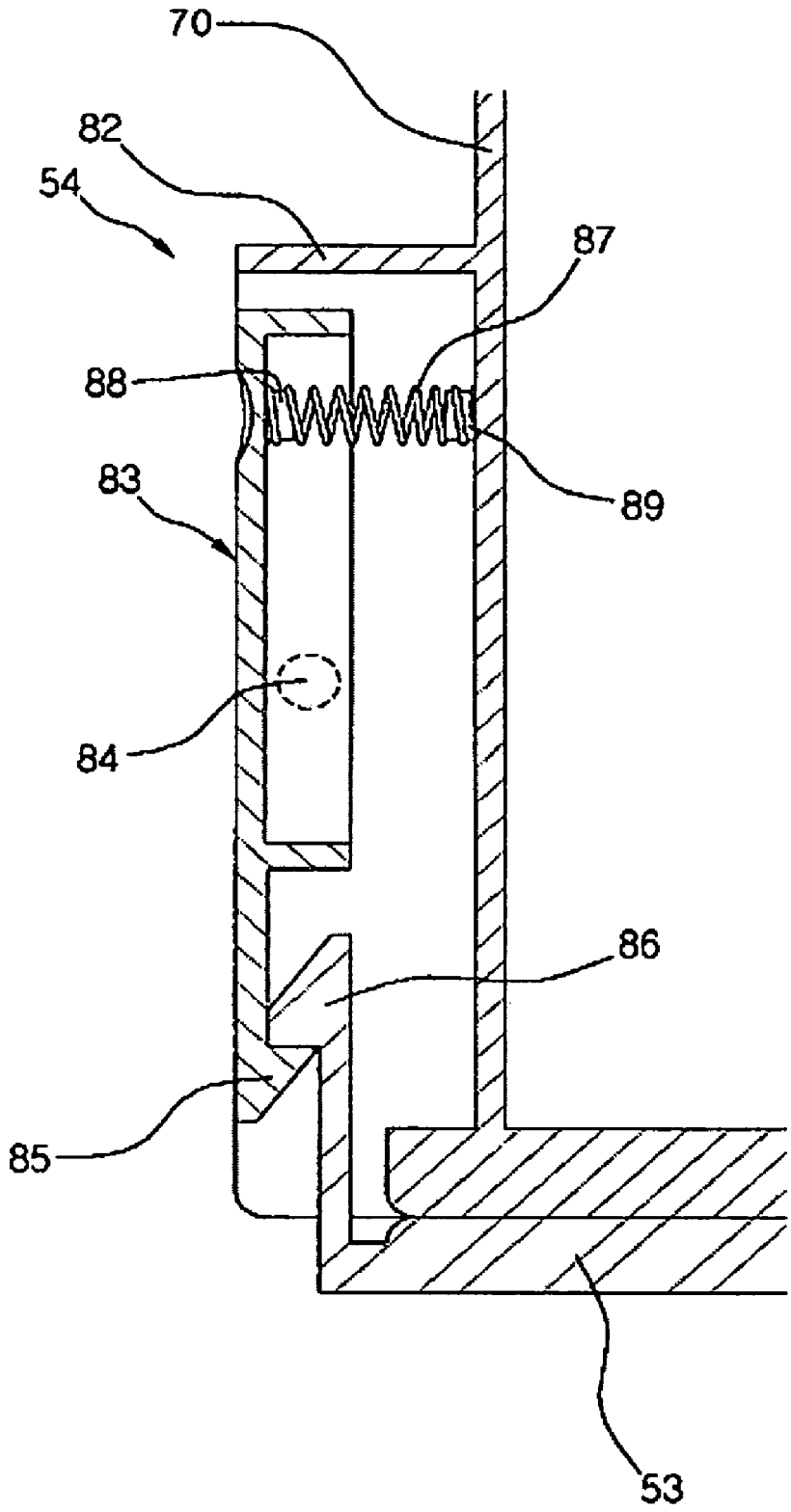
FIG. 7 is a sectional view of a bottom cover fixing means, taken along line A–A' of FIG. 4.

FIG. 7 is a sectional view taken along line A–A' of FIG. 4, and more specifically shows a sectional view of the bottom cover fixing means.

Referring to FIG. 7, the bottom cover fixing means 54 for locking the bottom cover 53 of the dust collecting chamber comprises a protrusion 82 which protrudes outwardly from the outer surface of the dust collecting casing 80, an operating member 83 formed at a level corresponding to a protruding end of the protrusion 82, a hinge shaft 84 for allowing the operating member to be pivotally hinged to the protrusion 82 at the protruding end, an movable latch 85 formed at a lowermost end of the operating member 83, a stationary latch 86 integrally formed with the bottom cover 53 to protrude upwardly from a rear end of the bottom cover 53, and an elastic member 87 mounted between a back surface of an upper end of the operating member 83 and a front surface of the dust collecting casing 80.

The operation of the bottom cover fixing means so constructed will be now explained. The bottom cover 53 of the dust collecting chamber is not opened when the movable latch 85 and the stationary latch 86 are engaged with each other. However, if the operating member 83 is pivoted on the hinge shaft 84 and the movable latch 85 is then disengaged from the stationary latch 86, the bottom cover 53 is pivoted on the hinge portion 81 (FIG. 4) by its weight so that the bottom faces of the dust collecting chambers 50 and 60 are opened.

When the bottom faces, i.e. the bottom cover 53, of the dust collecting chambers 50 and 60 are opened, the dust and dirt accumulated in the dust collecting chambers 50 and 60 are dropped to the outside due to their weight so that they can be easily removed from the dust collecting chambers 50 and 60.

To conduct the operation for discharging the duct and dirt, the user of the vacuum cleaner only pushes an upper portion of the operating member 83 inwardly. Further, when an external force is not applied to the upper portion of the operating member, the operating member 83 is restored to its original position due to a restoring force of the elastic member 87.

To fix the elastic member 87 at a predetermined position, first and second supports 88 and 89 are formed on the back surface of the operating member 83 and the front surface of the dust collecting casing 80, respectively. Then, both ends of the elastic member 87 are fitted around the first and second supports 88 and 89, respectively, so that the elastic member 87 cannot be removed from the supports.

To this end, the bottom cover 53 is designed to cover the whole bottom faces of the main and auxiliary dust collecting chambers 50 and 60. When the bottom cover 53 is opened by the opening operation of the bottom cover fixing means 54, all the dust and dirt collected in the dust collecting chambers 50 and 60 are dropped due to their own weight.

Figure 8:
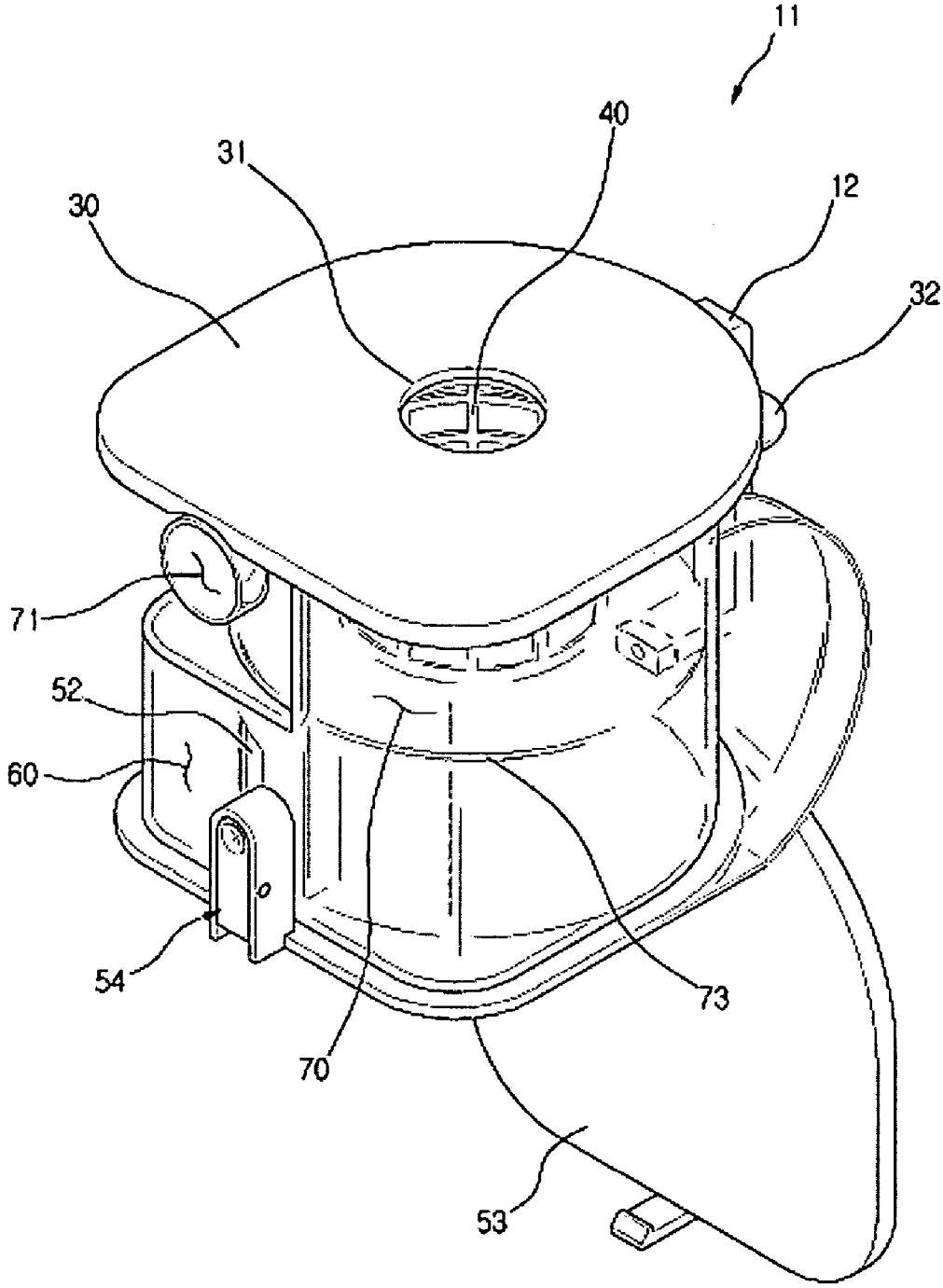
FIG. 8 is a view illustrating a state where a bottom surface of the dust collecting chamber is opened.

FIG. 8 is a view illustrating a state where the bottom cover fixing means 54 has been opened. In a case where the bottom faces of the dust collecting chambers are opened as shown in FIG. 8, the dust and dirt accumulated in the dust collecting chambers 50 and 60 can be easily discharged. At this time, the dust collecting unit can be stably maintained since the user holds the grip 12 of the dust collecting unit.

According to the present invention so constructed, the following advantages can be expected.

First, since an amount of the air to be sucked and the efficiency of collecting the dust and dirt can be increased, even a small capacity motor can be used. Therefore, there is an advantage in that the low-price vacuum cleaner can be implemented.

Further, since the dust and dirt accumulated in the vacuum cleaner can be easily removed, there is another advantage in that the convenience of use of the vacuum cleaner is enhanced.

Furthermore, since the auxiliary dust collecting chamber is formed together with the main dust collection chamber, there is still another advantage in that the amount of dust and dirt to be accumulated can be further increased and even the fine dust which cannot be collected in the main dust collecting chamber can be completely removed.

The scope of the present invention is not limited to the embodiment described and illustrated above but is defined by the appended claims. It will be apparent that those skilled in the art can make various modifications and changes thereto within the scope of the invention defined by the claims. Therefore, the true scope of the present invention should be defined by the technical spirit of the appended claims.

What is claimed is:

1. A dust collecting unit for a vacuum cleaner, comprising:
   - a dust separating chamber with an air inlet formed on an outer surface thereof in a tangential direction;
   - a main dust collecting chamber formed in the dust separating chamber for separating dust and dirt in a cyclonic fashion;
   - an auxiliary dust collecting chamber formed at one side of the main dust collecting chamber and the dust separating chamber, wherein a communicating hole is formed at a lower side of the main dust collecting chamber for causing air to be introduced from the main dust collecting chamber to the auxiliary dust collecting chamber, and a communicating hole is formed at an upper side of the dust separating chamber for causing air to be introduced from the dust separating chamber to the auxiliary dust collecting chamber; and
   - a cover which is mounted to open and close on a top face of the dust separating chamber, wherein an opening is formed in the center of the cover, and wherein air is discharged through the opening.

2. The dust collecting unit as claimed in claim 1, further comprising a filter mounted to the dust separating chamber for filtering Out fine dust.

3. The dust collecting unit as claimed in claim 1, further comprising a partition plate partitioning the main dust collecting chamber from the dust separating chamber such that the main dust collecting chamber has an upper cyclonic part where air flows cyclonically and a lower collecting part without cyclonic air flow.

4. The dust collecting unit as claimed in claim 3, wherein the partition plate is integrally formed with a dust collecting casing at an inner surface thereof.

5. The dust collecting unit as claimed in claim 4, wherein the partition plate is formed with one or more openings at an outer periphery thereof.

6. The dust collecting unit as claimed in claim 1, wherein at least one stop plate is formed on an inner surface of the main dust collecting chamber.

7. A removable dust collecting unit for a cyclonic vacuum cleaner, comprising:
   - a top cover having a centrally located air outlet;
   - a dust collecting casing comprising a main dust collecting chamber formed within the dust collecting casing and an auxiliary dust collecting chamber located externally adjacent to the main dust collecting chamber, wherein communicating holes are formed to open into the auxiliary dust collecting chamber, wherein one of the communicating holes is formed at an upper portion of the dust collecting casing, and one of the communicating holes is formed at a lower portion of the main dust collecting chamber; and a bottom cover, wherein the top cover is freely detachable from the dust collecting casing while the bottom cover is fixably hinged to the dust collecting casing by a hinge on one side; and a filter attachable to the top cover.

8. The dust collecting unit as claimed in claim 7, further comprising an air inlet formed tangentially to the dust collecting casing.

9. The dust collecting unit as claimed in claim 7, wherein the main dust collecting chamber is divided into an upper chamber and a lower chamber by a partition plate.

10. The dust collecting unit as claimed in claim 9, wherein air flows cyclonically in the upper chamber, and air does not flow cyclonically in the lower chamber.

11. The dust collecting unit of claim 7, wherein at least one stop plate is formed on an inner surface of the main dust collecting chamber.

12. A dust collecting unit for a vacuum cleaner, comprising:

a dust separating chamber with an air inlet formed on an outer surface thereof in a tangential direction;

a main dust collecting chamber formed in the dust separating chamber for separating dust and dirt in a cyclonic fashion;

an auxiliary dust collecting chamber formed at one side of the main dust collecting chamber and the dust separating chamber;

a cover which is mounted to open and close on a top face of the dust separating chamber, wherein an opening is formed in the center of the cover, and wherein air is discharged through the opening; and a filter mounted to the dust separating chamber for filtering out fine dusts wherein an upper communication hole is formed in an upper portion of the dust separating chamber for communication between the dust separating chamber and the auxiliary dust collecting chamber and a lower communication hole is formed in a lower portion of the main dust collecting chamber for communication between the main and auxiliary dust collecting chambers.

13. A removable dust collecting unit for a cyclonic vacuum cleaner, comprising:

a top cover having a centrally located air outlet;

a dust collecting casing comprising a main dust collecting chamber formed within the dust collecting casing and an auxiliary dust collecting chamber located externally adjacent to the main dust collecting chamber; and a bottom cover, wherein the top cover is freely detachable from the dust collecting casing while the bottom cover is fixably hinged to the dust collecting casing by a hinge on one side, wherein a communicating hole is formed between the main dust collecting chamber and the auxiliary dust collecting chamber, wherein the communicating hole is formed at an upper portion of the main dust collecting chamber, and wherein the communicating hole formed at the upper portion of the main dust collecting chamber comprises an upper communicating hole, and further comprising a communicating hole formed at a lower point of the main dust collecting chamber.

* * * * *